US008460056B2

(12) United States Patent
Haddadi et al.

(10) Patent No.: US 8,460,056 B2
(45) Date of Patent: Jun. 11, 2013

(54) DEVICE FOR MACHINING AN OPHTHALMIC LENS

(75) Inventors: Ahmed Haddadi, Charenton le Pont (FR); Francisco Briegas, Charenton le Pont (FR)

(73) Assignee: Essilor International (Compagnie Generale d'Optique), Charenton-le-Pont (FR)

( * ) Notice: Subject to any disclaimer, the term of this patent is extended or adjusted under 35 U.S.C. 154(b) by 799 days.

(21) Appl. No.: 12/644,940

(22) Filed: Dec. 22, 2009

(65) Prior Publication Data

US 2010/0184356 A1 Jul. 22, 2010

(30) Foreign Application Priority Data

Jan. 21, 2009 (FR) ..... 09 00257

(51) Int. Cl.
*B24B 13/06* (2006.01)

(52) U.S. Cl.
USPC ..... 451/5; 451/8; 451/43

(58) Field of Classification Search
USPC ..... 451/5, 8–11, 42–44
See application file for complete search history.

(56) References Cited

U.S. PATENT DOCUMENTS 5,155,940 A * 10/1992 Suzuki ..... 451/5
6,688,944 B2 * 2/2004 Hatano et al. ..... 451/5
6,896,587 B2 * 5/2005 Guillermin et al. ..... 451/8
7,338,347 B2 * 3/2008 Gottschald et al. ..... 451/11
7,628,486 B2 * 12/2009 Tanaka et al. ..... 351/159.75
7,740,519 B2 * 6/2010 Hatano et al. ..... 451/5
7,740,520 B2 * 6/2010 Hatano et al. ..... 451/5
8,260,450 B2 * 9/2012 Takeichi ..... 700/164

FOREIGN PATENT DOCUMENTS

FR 2 907 041 4/2008

OTHER PUBLICATIONS

French Search Report dated Sep. 10, 2009, from corresponding French application.

* cited by examiner

*Primary Examiner* — Dung Van Nguyen
(74) *Attorney, Agent, or Firm* — Young & Thompson

(57) ABSTRACT

The shaper device for shaping an ophthalmic lens comprises a blocking support on a blocking axis, a shaper tool, an electronic or computer unit for controlling the position of said shaper tool, and a man/machine interface connected to said electronic or computer unit, and comprising a display screen (253) and input means for inputting numerical values. The electronic or computer unit is adapted to display on said display screen at least three so-called "offset" fields (301-304) for inputting numerical values via said input means, the fields being displayed simultaneously or in succession, then for generating a control setpoint for said shaper tool relative to said blocking support, for shaping the ophthalmic lens by forming an engagement ridge on its edge face, the ridge presenting, at each axial section of the ophthalmic lens, a profile having front and rear ends that present respective first and second distances from the blocking axis, with the difference between said distances being a so-called "offset" function that is not entirely uniform around the edge face of the ophthalmic lens, and that depends on the numerical values input in each of the offset fields.

10 Claims, 9 Drawing Sheets

Fig.7A
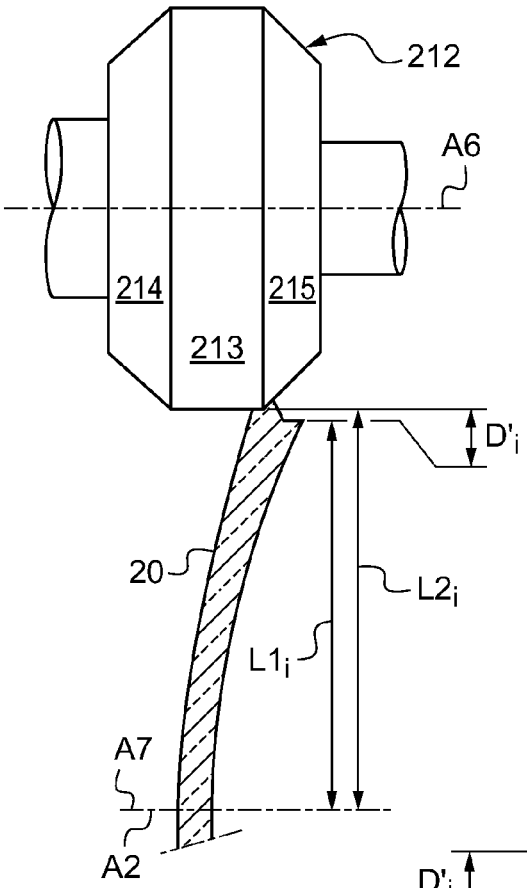
Fig.7B
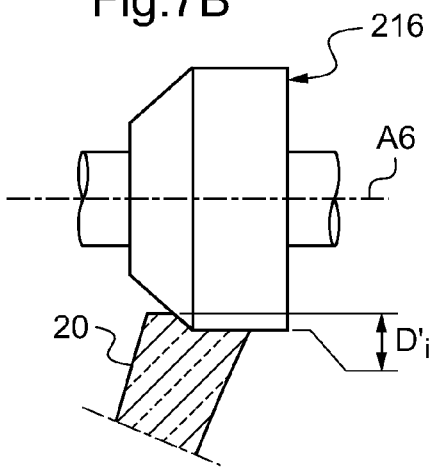
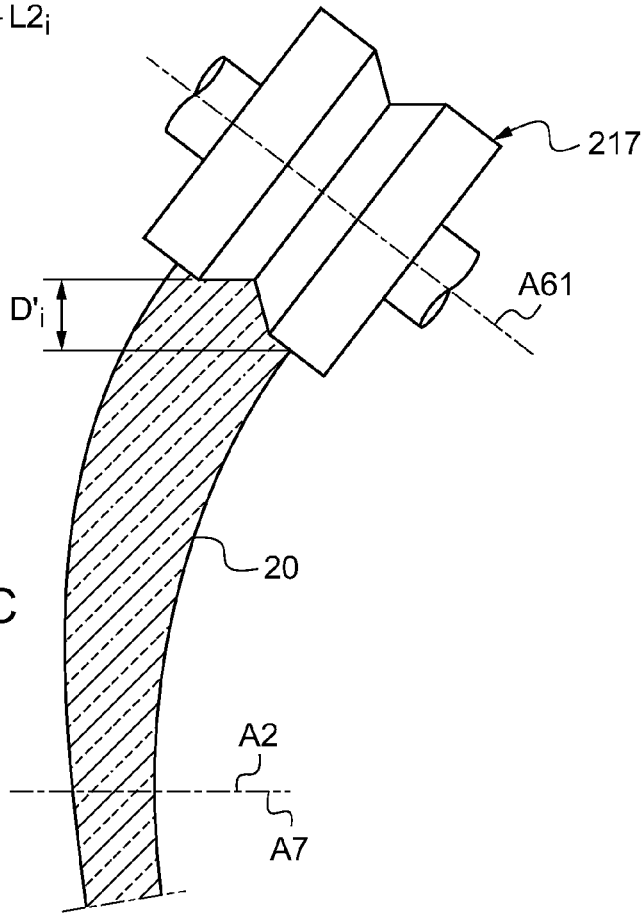
Fig.7C

Fig.12
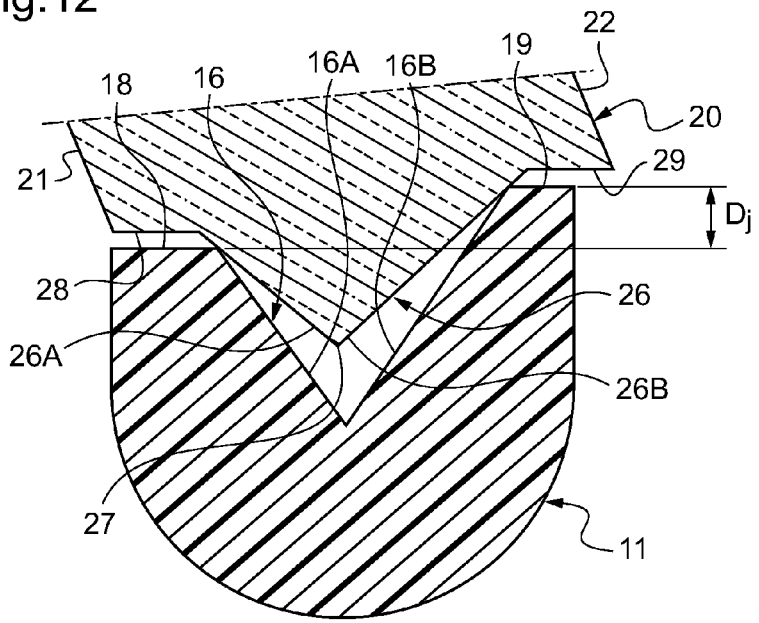
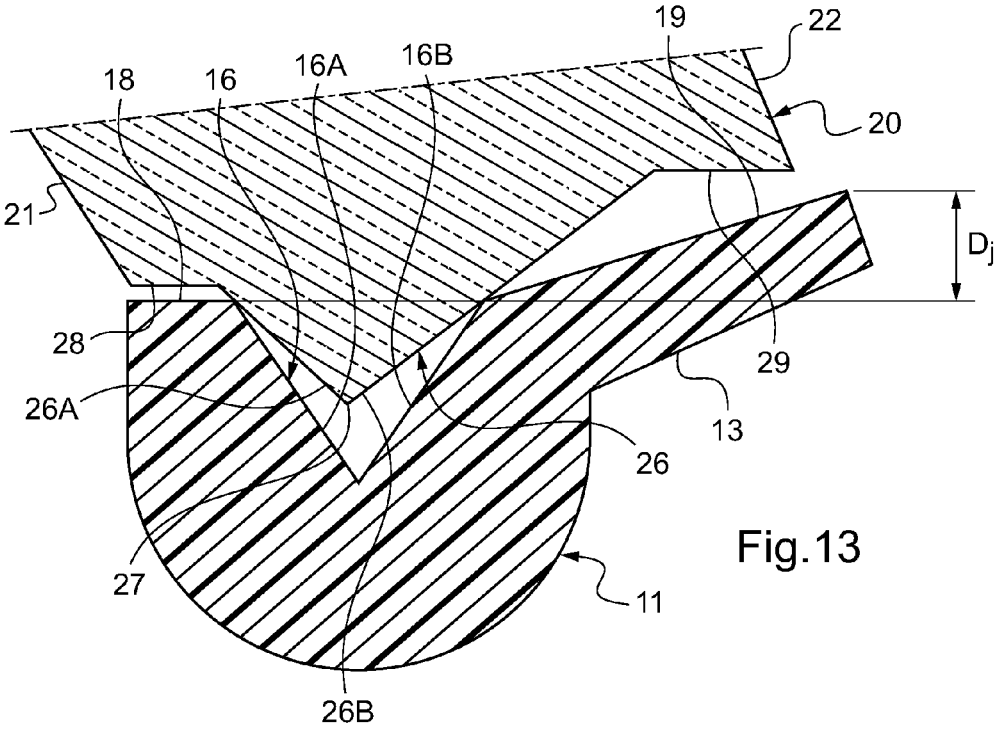
Fig.13

DEVICE FOR MACHINING AN OPHTHALMIC LENS

TECHNICAL FIELD TO WHICH THE INVENTION RELATES

The present invention relates in general to the field of eyeglass manufacture, and more precisely to machining ophthalmic lenses.

It relates more particularly to a shaper device for shaping an ophthalmic lens for mounting in a bezel of a rim of an eyeglass frame, so as to form an engagement ridge on the edge face of the lens, which rim presents a transverse profile that is not uniform all around the outline of the lens.

TECHNOLOGICAL BACKGROUND

The technical portion of an optician's occupation consists in mounting a pair of ophthalmic lenses in a frame selected by a wearer. Such mounting comprises three main operations:

- acquiring the shape of the bezel in each of the two rims of the eyeglass frame as selected by the future wearer, in particular acquiring the shape of the grooves running around the insides of the rims of the frame;
- centering each lens, i.e. determining the position that each lens is to occupy relative to the frame in order to be suitably centered in front of the pupil of the wearer's eye so that the lens performs properly the optical function for which it is designed; and
- shaping each lens, i.e. machining or cutting its outline to the desired shape, taking account of the shape of the bezel and of defined centering parameters, with the machining terminating in a step of making a bezel, i.e. making an engagement ridge on the edge face of the lens so as to hold said lens in the bezel of the frame.

In the context of the present invention, attention is directed mainly to the third operation of machining the edge face of the lens.

It is well known to perform this operation by means of a shaper device that includes a lens blocking support, a shaper tool that is movable relative to the support, and an electronic and/or computer unit for controlling the position of the machining tool relative to the support. The electronic and/or computer unit is thus adapted to acquire the coordinates of a plurality of points that are felt around the bezel of each rim of the frame, and then to deduce therefrom a control setpoint for the machining tool relative to the support so as to form a profiled engagement ridge on the edge face of the lens.

It is also known to use an optimized feeler and shaper device designed to form a non-uniform engagement ridge on the edge face of the lens so as to take account of variations in the shapes of the bezels of eyeglass frame rims.

Such a device serves in particular to take account of the skew of the bezel, i.e. of variations in the angle of inclination of the bezel around the outline of each rim. This angle of inclination is not negligible in the temple and nose zones of rims, especially when the frame is particularly long or curved.

The device also enables account to be taken of perceptible variations in the shape of the bezel due to each rim of the frame having connections with the bridge, a temple, and a nose pad.

For this purpose, the device is suitable for feeling a plurality of cross-sections of the inside face of each rim and for deducing therefrom, by calculation, an approximation to the three-dimensional shapes of the bezel and of its front and rear margins.

It is then suitable for shaping the ophthalmic lens so that the engagement ridge presents a profile at each axial section of the lens that is not uniform and that is adapted to the shape of the corresponding profile of the bezel of the rim. Thus, once the lens is engaged in the frame, no unsightly gap appears between the rim of the frame and the ophthalmic lens.

Nevertheless, such a feeler device is expensive. It is also particularly time-consuming to use. That device also presents performance that is not always adequate since it does not enable the positions of the nose pads and of the temples of the frame to be determined, and that runs the risk of leaving problems of mechanical interference between the lens and the frame whenever the lens is particularly thick.

OBJECT OF THE INVENTION

The object of the present invention is to provide a shaper device for shaping an ophthalmic lens, the device being simple and compensating the defects of devices for feeling the rims of eyeglass frames.

To this end, the invention provides a shaper device for shaping an ophthalmic lens, the device comprising:

- a blocking support for blocking the ophthalmic lens on a blocking axis;
- a shaper tool for shaping the ophthalmic lens, the tool being movable relative to said blocking support;
- an electronic and/or computer unit for controlling the position of said shaper tool relative to said blocking support; and
- a man/machine interface connected to said electronic and/or computer unit and including a display screen and input means for inputting numerical values;

wherein said electronic and/or computer unit is adapted to display on said display screen at least three so-called "offset" fields for inputting numerical values via said input means, said fields being displayed simultaneously or in succession, and then for generating a control setpoint for said shaper tool relative to said blocking support for shaping the ophthalmic lens so as to form an engagement ridge on its edge face, which ridge presents, in each axial section of the ophthalmic lens, a profile having front and rear ends that present respective first and second distances from the blocking axis with the difference between said distances being a so-called "offset" function that is not entirely uniform around the edge face of the ophthalmic lens, and that depends on the numerical values input into each of the offset fields.

Using a simple feeler device that is inexpensive makes it possible only to acquire the shape of the bottom edge of the bezel in each rim of the eyeglass frame selected by the wearer. It is generally not possible with such a device to determine the relative positions of the front and rear margins on either side of the bezel.

The invention enables the user of the shaper device to measure or to approximate the differences in height between the front and rear margins of the bezel by hand or by eye at a small number of apparently-pertinent distinct sections around the rim, so that the engagement ridge is machined as a function of those height differences.

Measuring height differences then presents the advantage of being an operation that can be performed without special tooling and without requiring much time.

The measurements taken are then input to the shaper device so that it machines the engagement ridge to have a profile that is not uniform, making it possible firstly to avoid problems of mechanical interference between the lens and the frame, and secondly to avoid the edge face of the lens extending at a distance from the rim, which would leave an unsightly gap (also known as the facetting effect).

More precisely, it is generally observed that the difference in height between the front and rear margins of the bezel varies continuously around the rim. This difference in height can therefore easily be approximated in each axial section of the rim on the basis of measuring the height differences at three distinct sections of the rim.

Furthermore, the height difference may be measured either between the front and rear margins of the bezel, or between the front margin of the bezel and an obstacle of the rim (temple, bridge, nose pad), so as to ensure that once the lens has been shaped, it does not interfere with the obstacle. The user thus has great latitude in optimizing the shaping of the ophthalmic lens as he or she sees fits.

Other characteristics of the shaper device of the invention that are advantageous and not limiting are as follows:

- said electronic and/or computer unit is adapted to display on the display screen at least two superposed outlines simultaneously, each outline being a function of said control setpoint, and only a first outline being dependent on said offset function;
- the first of the two outlines is representative of the outline described by one of the ends of the profile of the engagement ridge around the edge face of the ophthalmic lens, and the second of the two outlines is representative of the outline described by the top of the profile of the engagement ridge around the edge face of the ophthalmic lens;
- said electronic and/or computer unit is adapted to display on said display screen exactly four offset fields;
- said electronic and/or computer unit is adapted to display on said display screen a preliminary field for inputting a natural number greater than or equal to 3, and then for displaying on said display screen a number of offset fields that is equal to said natural number;
- said electronic and/or computer unit is adapted to generate the control setpoint in such a manner that the offset function varies continuously;
- said electronic and/or computer unit is adapted to generate the control setpoint in such a manner that, relative to the angular position of the axial section in question, the offset function presents a derivative that is continuous;
- said electronic and/or computer unit is adapted to generate a control setpoint in such a manner that the absolute value of said derivative is less than a predetermined threshold value at each axial section of the lens;
- said electronic and/or computer unit is adapted to generate a control setpoint in such a manner that the offset function varies stepwise; and
- said electronic and/or computer unit is adapted to display on the display screen a transverse profile of the rim of the eyeglass frame simultaneously with the profile ($P'_i$) of said engagement ridge.

DETAILED DESCRIPTION OF AN EMBODIMENT

The following description with reference to the accompanying drawings, given by way of non-limiting example, makes it possible to understand what the invention consists in and how it can be reduced to practice.

In the accompanying drawings:

FIG. 7A is a diagrammatic view of a finishing wheel of the FIG. 6 shaper appliance;

FIGS. 7B and 7C are diagrammatic views of two variant embodiments of the FIG. 7A finishing wheel;

FIGS. 10 to 15 are section views at different cross-sections of the FIG. 3 ophthalmic lens and of the FIG. 1 eyeglass frame, engaged one in the other.

Eyeglass Frame

Figure 1:
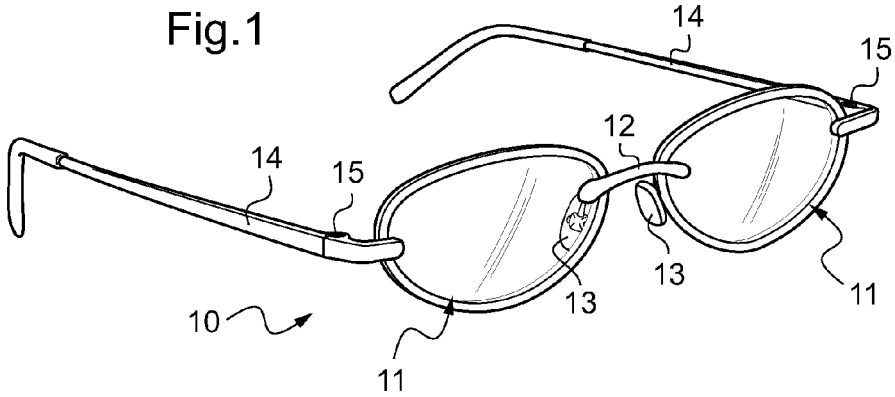
FIG. 1 is a perspective view of a rimmed eyeglass frame.

FIG. 1 shows a rimmed eyeglass frame 10 having two rims 11 (or surrounds), each serving to receive an ophthalmic lens and to be positioned in front of a respective one of the two eyes of a wearer when said frame is being worn. The two rims 11 are connected together by a bridge 12. They are also each fitted with a nose pad 13 suitable for resting on the wearer's nose and a temple (earpiece) 14 suitable for resting on one of the wearer's ears. Each temple 14 is hinged to the corresponding rim by means of a hinge 15.

Figure 2:
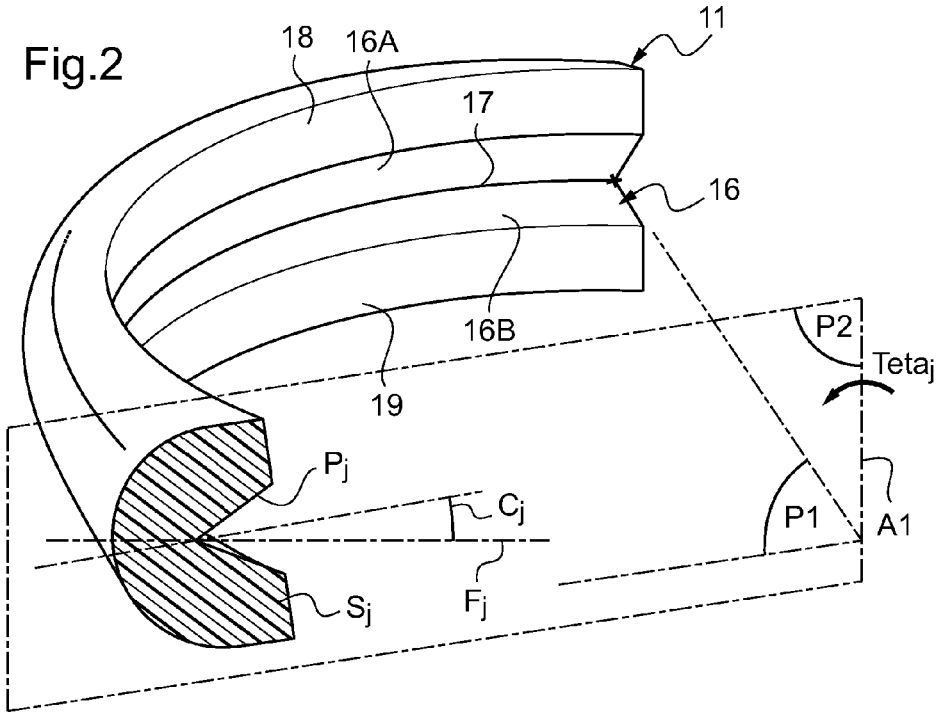
FIG. 2 is a perspective view of a portion of a rim of the FIG. 1 eyeglass frame.

As shown in FIG. 2, each rim 11 of the eyeglass frame 10 presents an inside face including an inside groove, commonly referred to as a bezel 16. In this embodiment, the bezel 16 presents a V-shaped cross-section with front and rear flanks 16A and 16B and a bottom edge 17. It is bordered by front and rear margins 18 and 19. In a variant, the bezel could naturally be of some other shape, for example it could be circularly arcuate.

Relative to each of the rims 11, there is defined a mean plane P1 and a mean axis A1. The mean plane P1 is defined as the plane that comes closest to the set of points making up the bottom edge 17 of the bezel 16. The coordinates of this plane may be obtained, for example, by applying the least squares method to the coordinates of a plurality of points on the bottom of the bezel. The mean axis A1 is defined as being the axis normal to the mean plane P1, passing through the barycenter (center of gravity) of the points making up the bottom edge 17 of the bezel 16.

The cross-section $S_j$ of each rim 11 is defined as being the intersection of the rim 11 with a plane P2 that contains the mean axis A1 and that presents an angle of orientation $TETA_j$ [i.e. $theta_j$] around said axis.

Each cross-section $S_j$ defines a rim profile $P_j$. Each of these profiles $P_j$ in this embodiment comprises two parallel segments corresponding to the traces of the front and rear margins 18 and 19 in the plane P2, and two V-shaped segments corresponding to the traces of the front and rear flanks 16A and 16B in the plane P2.

The rim profiles $P_j$ are of shapes that vary around the outline of each rim 11.

Figure 10:
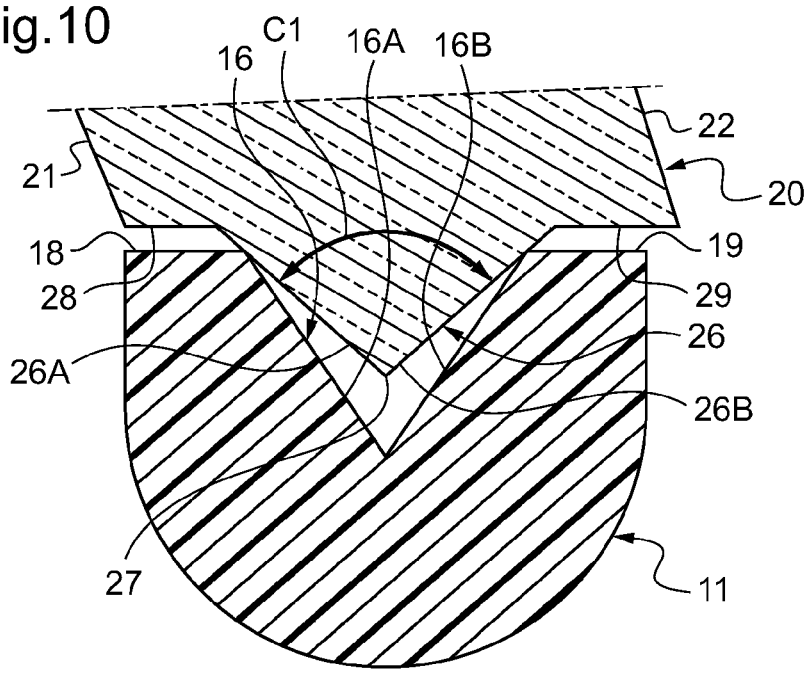

In particular, as shown in FIGS. 10 and 12, the front and rear margins 18 and 19 present respective first and second distances from the mean axis A1 presenting a difference referred to as the offset height $D_j$ that varies along the outline of each rim 11.

The offset height $D_j$ is defined more precisely as the difference between firstly the minimum distance to the mean axis A1 of the trace of the front margin 18 in the cross-section $S_j$ under consideration, and secondly the minimum distance to the mean axis A1 of the trace of the rear margin 19 in said cross-section $S_j$.

Figure 11:
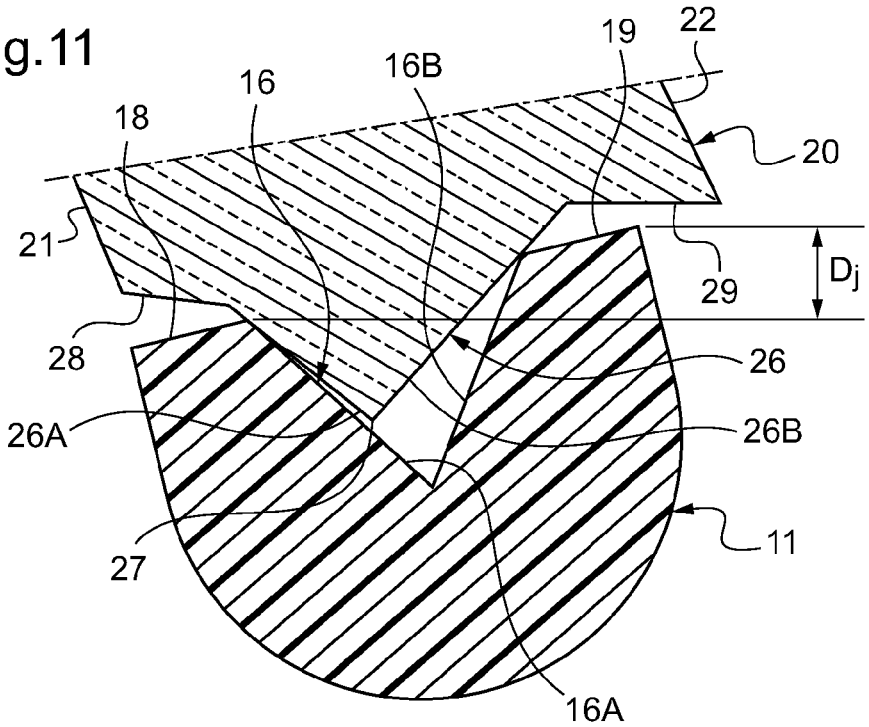
Figure 14:
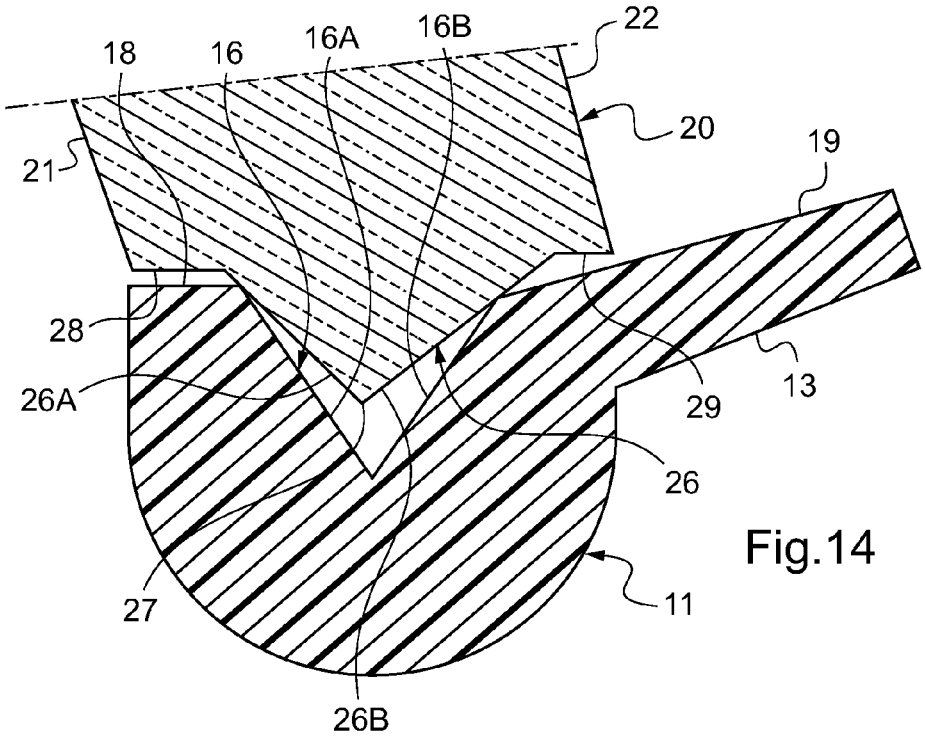

The eyeglass frame 10 is also cambered. The bezels 16 are thus skewed, i.e. twisted. Consequently, and as shown in FIG. 2, each cross-section $S_j$ of the bezel 16 presents its own angle of inclination. This angle of inclination, which varies along the bezels 16, is quantified in each cross-section $S_j$ in terms of an angle $C_j$ referred to the skew angle. The skew angle $C_j$ corresponds to the angle between the bisector $F_j$ of the bezel 16 and the mean plane P1 of the rim 11. This skew angle $C_j$ is generally zero in the nose zones of the rims 11 of the frame 10 and at a maximum in its temple zones. With the help of FIGS. 10 and 11, it can be understood that the skew of the rims 11 has an influence on the offset height $D_j$.

Assuming, as shown in FIG. 13, that the nose pads 13 (and the hinges 15) form parts of and extend the rear margins 19, it can also be understood that the nose pads 13 (and the hinges 15) have an influence on the offset height $D_j$.

Ophthalmic Lens

Figure 3:
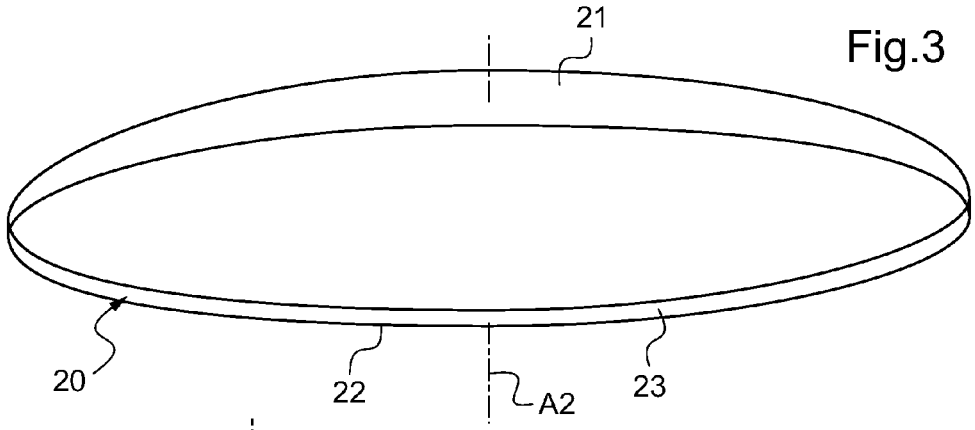
FIG. 3 is a perspective view of an ophthalmic lens.
Figure 4:
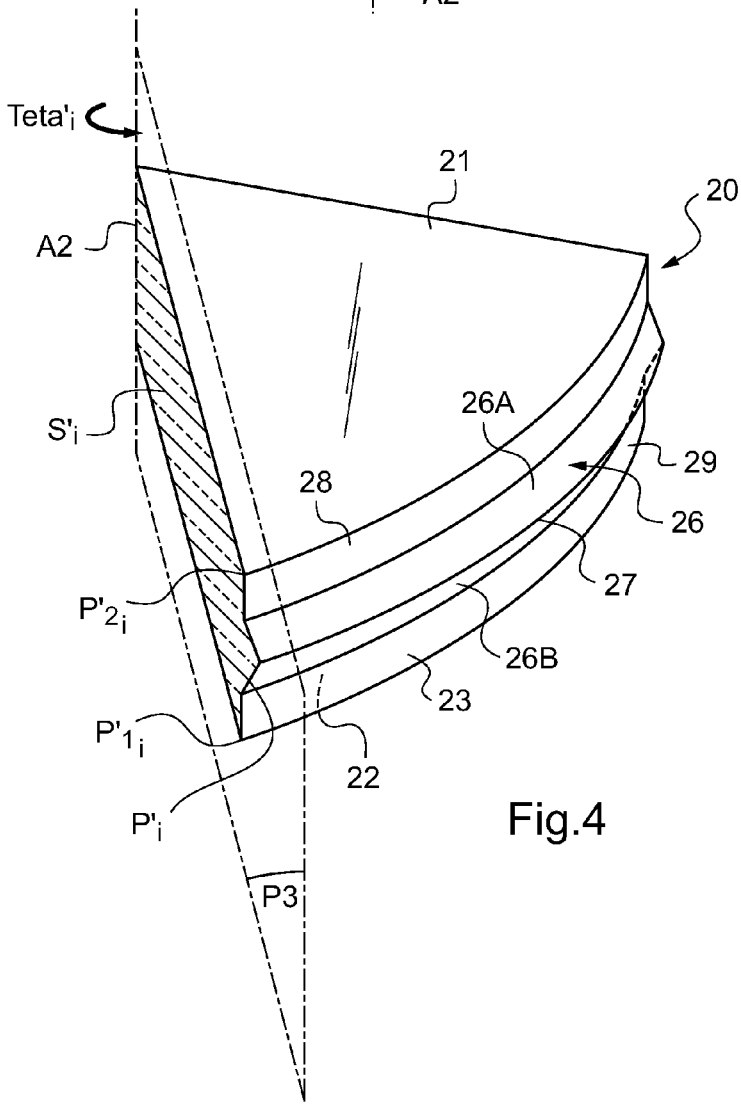
FIG. 4 is a perspective view of a portion of the FIG. 3 ophthalmic lens.

As shown in FIGS. 3 and 4, the ophthalmic lens 20 presents front and rear optical faces 21 and 22, together with an edge face 23.

The ophthalmic lens 20 presents optical characteristics and geometrical characteristics.

Amongst its optical characteristics, there is defined in particular the spherical refringent power of the lens, which is the magnitude that characterizes and quantifies the "magnifying glass" effect of the lens on the beam under consideration. The point of the lens where the magnifying glass effect is zero (i.e. for a lens that has spherical optical power only, the point where the incident ray and the transmitted ray have the same axis) is referred to as the optical center. The corresponding axis is referred to as the optical axis A2.

The edge face 23 of the lens initially presents an outline that is circular (FIG. 3). Nevertheless, the lens is designed to be shaped to match the shape of the corresponding rim of the eyeglass frame 10, so as to enable it to be engaged therein.

As shown in FIG. 4, the lens is more precisely designed to be shaped so as to present on its edge face 23 an engagement ridge 26 (or bevel) bordered by front and rear margins 28 and 29 (also referred to as bevel flats). The engagement ridge 26 described herein presents a V-shaped section with a top edge 27 that runs along the edge face 23 of the lens, with front and rear flanks 26A and 26B on either side of the top edge 27.

In a variant, the edge face of the ophthalmic lens could be shaped so as to present a profile of some other shape. For example, the lens should be shaped to present an engagement ridge that is machined beside its rear flank only and that is bordered on only one side by a rear margin (FIG. 7B). In this example, the front flank of the engagement ridge is formed by the front face of the lens and is therefore not machined (or is merely chamfered). It can be understood that the top edge of the engagement ridge is then constituted by the line joining the front face of the lens and the rear flank of the engagement ridge. Such a lens is described in greater detail in document FR 2 904 703.

The axial section $S'_i$ of the ophthalmic lens 20 is defined as the intersection of said lens with a half-plane P3 that is defined by the optical axis A2 and that presents an angle of orientation $TETA'_i$ about said axis.

Each axial section $S'_i$ of the ophthalmic lens 20 defines a lens profile $P'_i$. Each of these profiles $P'_i$ in this example comprises two parallel segments corresponding to the traces of the front and rear margins 28 and 29 in the half-plane P3, and two segments in a V-shape corresponding to the traces of the front and rear flanks 26A and 26B in the half-plane P3.

The axial sections $S'_i$ of the lens 20 and the cross sections $S_j$ of the frame 10 are said to "correspond" when the angular positions thereof $TETA'_i$ and $TETA'_j$ in the planes that define them are equal.

Reader Appliance

In order to implement the method of the invention, it is possible to make use of a shape reader appliance. This shape reader appliance comprises means that are well known to the person skilled in the art and it does not specifically form the subject matter of the invention described. For example, it is possible to use a shape reader appliance as described in patent EP 0 750 172 or as sold by Essilor International under the trademark Kappa or under the trademark Kappa CT.

Figure 5:
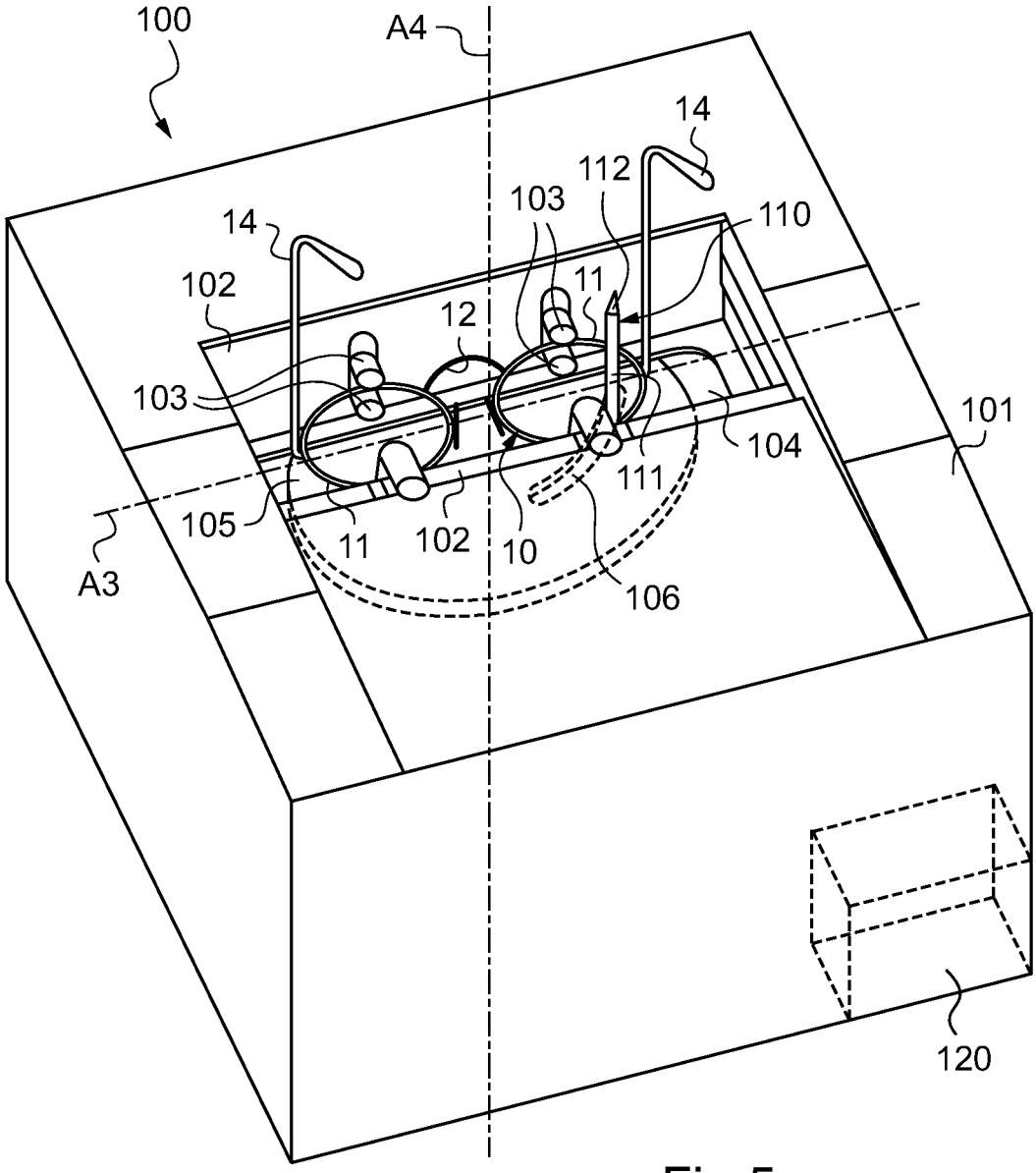
FIG. 5 is a perspective view of an appliance for reading the outline of an eyeglass frame rim, shown with the eyeglass frame of FIG. 1 installed therein.

FIG. 5 is a general view of the shape reader appliance 100, as it is presented to its user. The appliance has a top cover 101 covering all of the appliance with the exception of a central top portion in which an eyeglass frame 10 is placed.

The shape reader appliance 100 serves to read the shape of the bottom edge of the bezel in each rim 11 of the eyeglass frame 10.

The shape reader appliance 100 shown in FIG. 5 has a set of two jaws 102 with at least one of the jaws 102 being movable relative to the other so that the jaws 102 can be moved towards each other or away from each other in order to form a clamping device. Each of the jaws 102 is also provided with two clamps, each made up of two studs 103 that are movable so as to be capable of clamping the eyeglass frame 10 between them in order to prevent it from moving.

In the space left visible by the central top opening of the cover 101, there can be seen a structure 104. A plate (not visible) can be moved in translation on the structure 104 along a transfer axis A3. A turntable 105 is pivotally mounted on the plate. The turntable 105 is thus suitable for occupying two positions along the transfer axis A3, namely a first position in which the center of the turntable 105 is disposed between the two pairs of studs 103 holding the right rim of the eyeglass frame 10, and a second position in which the center of the turntable 105 is placed between the two pairs of studs 103 holding the left rim of the eyeglass frame 10.

The turntable 105 possesses an axis of rotation A4 defined as being the axis normal to the front face of the turntable 105 and passing through its center. It is adapted to pivot about said axis relative to the plate. The turntable 105 also has a circularly arcuate oblong slot 106 through which there projects a feeler 110. The feeler 110 comprises a support rod 111 of axis perpendicular to the plane of the front face of the turntable 105, and at its free end a feeler finger 112 of axis perpendicular to the support rod 111. The feeler finger 112 is designed to follow the bottom edge of the bezel of each rim 11 of the eyeglass frame 10 by sliding, or possibly by rolling, thereal-ong.

The shape reader appliance 100 includes actuator means (not shown) adapted firstly to cause the support rod 111 to slide along the slot 106 so as to modify its radial position relative to the axis of rotation A4 of the turntable 105, secondly so as to vary the angular position of the turntable 105 about its axis of rotation A4, and thirdly to position the feeler finger 112 of the feeler 110 at a higher or lower altitude relative to the plane of the front face of the turntable 105.

To summarize, the feeler 110 is provided with three degrees of freedom, namely a first degree of freedom R constituted by the ability of the feeler 110 to move radially relative to the axis of rotation A4 because of its freedom to move along the circular arc formed by the slot 106, a second degree of freedom TETA constituted by the ability of the feeler 110 to pivot about the axis of rotation A4 by virtue of the turntable 105 rotating relative to the plate, and a third degree of freedom Z constituted by the ability of the feeler 110 to move in translation along an axis parallel to the axis of rotation A4 of the turntable 105.

Each point read by the end of the feeler finger 112 of the feeler 110 is identified in a corresponding coordinate system $R_j$, $TETA_j$, $Z_j$.

The shape reader appliance 100 also includes an electronic and/or computer device 120 serving firstly to control the actuator means of the shape reader appliance 100, and secondly to acquire and store the coordinates of the end of the feeler finger 112 of the feeler 110.

Shaper Appliance

The shaper appliance of the invention may be implemented in the form of any machine for cutting or removing material and that is suitable for modifying the outline of the ophthalmic lens 20 in order to match it to the rim 11 of a selected frame, and/or in a drilling machine adapted to drill holes in the ophthalmic lens for fastening it to an eyeglass frame of the rimless type.

Figure 6:
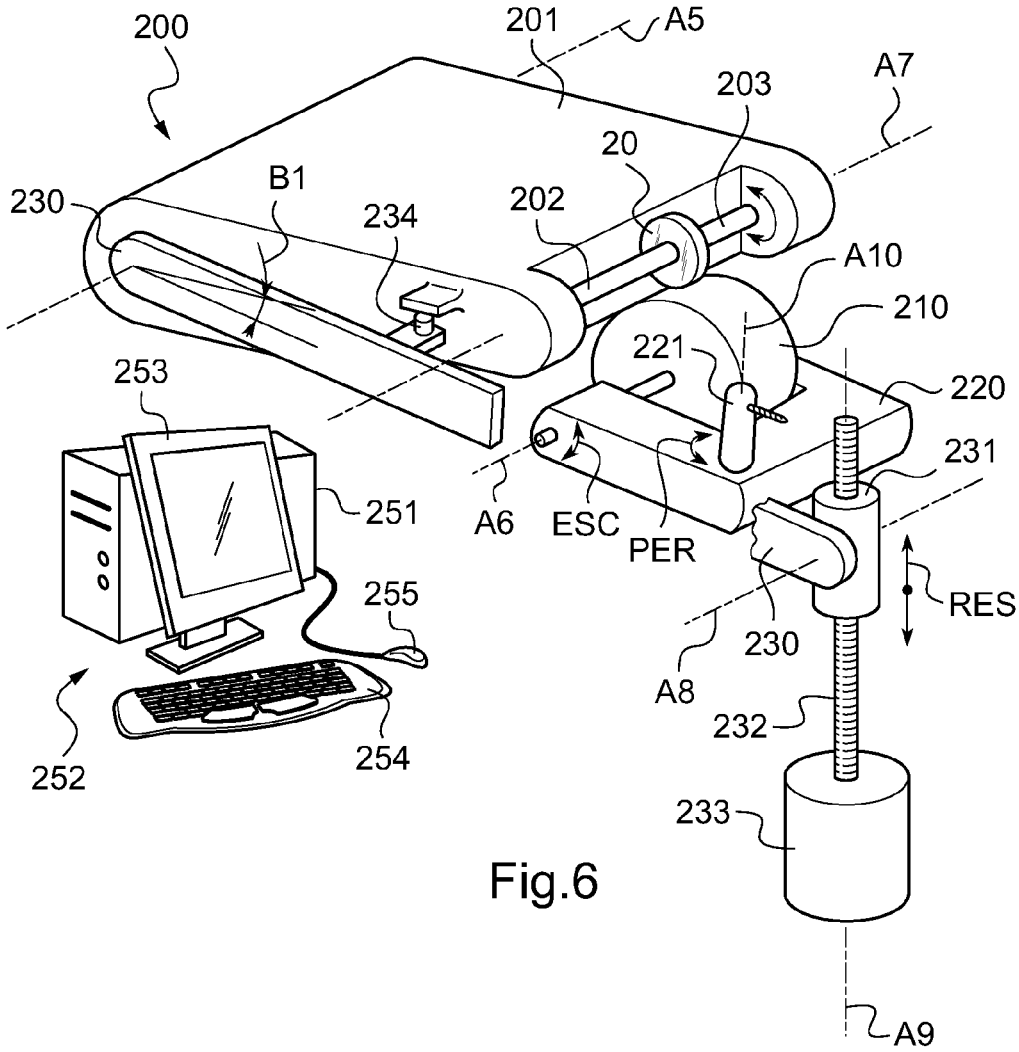
FIG. 6 is a diagrammatic view of an appliance for shaping an ophthalmic lens, having the ophthalmic lens of FIG. 3 blocked therein.

In the embodiment shown diagrammatically in FIG. 6, the shaper appliance is constituted, in known manner, by an automatic grinder 200, commonly said to be numerically controlled. Specifically, the grinder comprises:

- a rocker 201 mounted free to pivot about a reference axis A5, in practice a horizontal axis, on a structure that is not shown, and that serves to support the ophthalmic lens 20 for machining;
- at least one grindwheel 210 that is constrained to rotate on a grindwheel axis A6 parallel to the reference axis A5, and that is also suitably driven in rotation by a motor that is not shown; and
- a finishing module 220 that is mounted to rotate about the grindwheel axis A6 and that carries the drill means 220 for drilling the ophthalmic lens 20.

The rocker 201 is provided with a lens support, formed in this embodiment by two arms 202 and 203 for clamping and rotating the ophthalmic lens 20 for machining.

These two shafts 202 and 203 are in alignment with each other on a blocking axis A7 parallel to the axis A5. Each of the shafts 202 and 203 possesses a free end facing the free end of the other shaft and fitted with a blocking chuck for blocking the ophthalmic lens 20.

A first one of the two shafts 202 is not movable in translation along the blocking axis A7. The second one of the two arms 203 is movable in translation along the blocking axis A7 so as to clamp the ophthalmic lens 20 in axial compression between the two blocking chucks.

As shown diagrammatically in FIG. 6, the grinder 200 has only one cylindrical grindwheel 210.

In practice, it would normally have a set of several grindwheels mounted one after another on the grindwheel axis A6, each grindwheel being used for a specific machining operation on the ophthalmic lens 20 for machining.

For roughing out the lens, it is the cylindrical grindwheel 210 that is used.

For finishing the lens, a finishing wheel 212 is used that is adjacent to the cylindrical grindwheel 210.

As shown in FIG. 7A, the finishing wheel 212 may in particular have a cylindrical working face 213 between two conical working faces 214, 215, all three faces constituting respective surfaces of revolution about the grindwheel axis A6. A left half of the finishing wheel 212 is shaped to machine simultaneously the rear flank and the rear margin of the ophthalmic lens 20, while the right half of the finishing wheel 212 is shaped to machine simultaneously the front flank and the front margin of the ophthalmic lens 20. The finishing wheel 212 thus enables the ophthalmic lens 20 to be shaped in such a manner that the front and rear margins 18 and 19 present respective first and second distances $L1_i$ and $L2_i$ from the blocking axis A7, with the difference between those distances, referred to as the offset, being a function that is not entirely uniform around the edge face of the lens.

In a variant, it will be possible to use a finishing wheel 216 having a single conical working face (FIG. 7B) serving to machine the rear flank of the engagement ridge of the lens 20 (the front flank of the engagement ridge then being formed by the front face of the lens).

In another variant, provision can be made to use a form grindwheel 217 that is mounted to rotate about an axis A61 that can be tilted relative to the blocking axis A7 (FIG. 7C). Such a form grindwheel 217 presents a profile of shape that is identical to the negative of the shape of the profile that is to be generated on the edge face of the lens. In particular, it presents a beveling groove suitable for generating the engagement ridge on the edge face of the lens 20. The angle of inclination of the form grindwheel 217 enables the edge face of the lens to be machined so that its front and rear margins are both inclined relative to the blocking axis and so that they thus present distances from the blocking axis A7 that are different. It is then possible to modify those distances by adjusting the angle of inclination of the axis A61 of the form grindwheel relative to the blocking axis A7.

The set of grindwheels is carried by a carriage (not shown) that is movable in translation along the grindwheel axis A6. The movement in translation of the grindwheel-carrying carriage is referred to as "transfer" TRA.

It will be understood that this consists in moving the grindwheels relative to the lens and that, in a variant, it is possible for the lens to be axially movable, with the grindwheels remaining stationary.

The grinder 200 also includes a link 230 having one end hinged relative to the structure so as to pivot about the reference axis A5, and having its other end hinged relative to a nut 231 for pivoting about an axis A8 that is parallel to the reference axis A5.

The nut 231 is itself mounted to be movable in translation along a reproduction axis A9 perpendicular to the reference axis A5. As shown diagrammatically in FIG. 6, the nut 231 is a tapped nut in screw engagement on a treaded rod 232 which is aligned along the reproduction axis A9 and is driven in rotation by a motor 233.

The link 230 also has a contact sensor 234, e.g. constituted by a Hall effect cell, that interacts with a corresponding element of the rocker 201. The pivot angle of the link 230 about the reference axis A5 and relative to the horizontal is referenced B1. This angle B1 is linearly associated with the vertical movement in translation (reproduction or RES) of the nut 231 along the reproduction axis A9.

The finishing module 220 is movable in pivoting about the grindwheel axis A6, with this being referred to as retraction movement ESC. Specifically, the finishing module 220 is provided with a toothed wheel (not shown) that meshes with a gearwheel fitted to the shaft of an electric motor secured to the grindwheel-carrier carriage. This freedom of movement enables it to move towards or away from the ophthalmic lens 20.

The drill means 221 on board the finishing module 220 are constituted in this example by a drill having a drill bit 222 suitable for making drill holes in the ophthalmic lens 20 clamped between the two shafts 202 and 203. The drill is adapted to pivot about a swivel axis A10 orthogonal to the grindwheel axis A6. This freedom of movement, referred to as freedom to swivel PER, enables the drill bit 222 to be oriented relative to the lens.

When the lens 20 for machining, while appropriately clamped between the two shafts 202 and 203, is brought into contact with the grindwheel 210 or the finishing wheel 212, material is indeed removed therefrom until the rocker 201 comes into abutment against the link 230 via a rest. Abutment takes place at the contact sensor 234 and is duly detected thereby.

In order to machine the ophthalmic lens 20 to have a given outline, it thus suffices firstly to move the nut 231 accordingly along the reproduction axis A9 under the control of the motor 233 in order to control the reproduction movement RES, and secondly to cause the support shaft 202 and 203 to pivot correspondingly about the blocking axis A7. The reproduction movement of the rocker 201 and the rotary movement of the shafts 202 and 203 are controlled together by a control unit 251 suitably programmed for this purpose so that all of the points of the outline of the ophthalmic lens 20 are brought in succession to the appropriate diameter.

The control unit 251 is of the electronic and/or computer type and it serves in particular to control:

- the motor for driving movement in translation of the second shaft 203;
- the motor for driving rotation of both shafts 202 and 203;
- the motor for driving movement in translation of the grindwheel-carrier carriage in the transfer direction TRA;
- the motor 233 for driving movement in translation of the nut 231 along the reproduction axis RES;
- the motor for driving pivoting of the finishing module 220 about the retraction axis ESC; and
- the motor for driving pivoting of the drill 221 about the swivel axis PER.

Finally, the grinder 200 includes a man/machine interface (MMI) 252 that, in this example, comprises a display screen 253, a keyboard 254, and a mouse 255 adapted to communicate with the control unit 251. This MMI 252 enables the user to input numerical values via the display screen 253 so as to control the grinder 200 accordingly.

As shown in FIG. 6, the control unit is implemented on an office computer connected to the grinder 200. Naturally, in a variant, the software portion of the grinder could be implemented directly in an electronic circuit of the grinder. It could equally well be implemented on a remote computer, communicating with the grinder via a private network or a public network, e.g. using the Internet communications protocol (IP).

Figure 8:
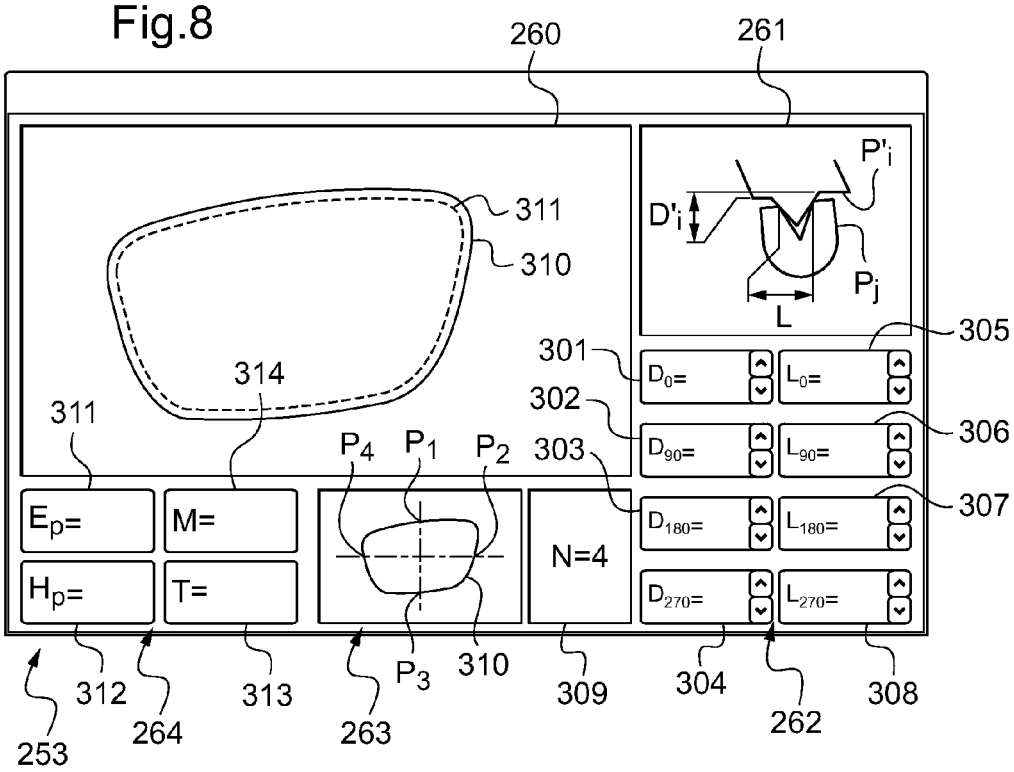
FIGS. 8 and 9 are views of the display screen of the FIG. 6 shaper appliance.

FIG. 8 shows the image displayed by the display screen 253 when the grinder 200 is started.

As shown in FIG. 8, the control unit 251 is adapted to display simultaneously on the display screen 253 various items of information including at least three offset fields 301-304 for inputting numerical values via the MMI 252.

In a variant, it could also display this information in succession, field by field, on a screen of smaller dimensions.

In this example, the control unit 251 is adapted to display:

- a first window 260 in which two outlines are displayed, a first outline 311 representative of the outline described by one of the ends $P'_i$1 of the lens profile $P'_i$ along the edge face of the lens, and a second outline 310 that is representative of the outline described by the top of the lens profile $P'_i$ along the edge face of the lens;
- a second window 261 displaying a rim profile $P_j$ and a lens profile $P'_i$ close together;
- a third window 262 displaying the four offset fields 301-304 together with four width fields 305-308;
- a fourth window 263 displaying firstly a preliminary field 309 for inputting a natural number N greater than or equal to 3, and secondly an outline 310 showing the outline of a rim of an ordinary eyeglass frame; and
- a fifth window 264 displaying four additional fields 311-314.

The term "representative" is used to mean that the outlines 310, 311 are orthogonal projections onto a common plane and with a common scale effect of the corresponding edges of the edge face 23 of the ophthalmic lens 20.

The use of these various windows 260-264 is described in greater detail below.

The method of preparing the ophthalmic lens 20 for mounting in the corresponding rim 11 of the eyeglass frame 10, e.g. the left rim, is implemented as follows.

Reading Method

During a first operation, the user proceeds with reading the left rim 11 of the eyeglass frame 10, using a reader appliance such as that shown in FIG. 5.

Initially, the eyeglass frame 10 is inserted between the studs 103 of the jaws 102 of the reader appliance 100 so that each of its rims 11 is ready for feeling along a path that begins with the feeler 110 being inserted between the two studs 103 clamping the bottom portion of the left rim 11 of the frame, and then passing along the bezel 16 of the rim 11 so as to cover the entire circumference of the rim 11.

In the initial position, when the feeler finger 112 is placed between the two studs 103, the electronic and/or computer device 120 defines the angular position $TETA_j$ and the altitude $Z_j$ of the end of the feeler finger 112 of the feeler 110 as being equal to zero.

Thereafter, the actuator means cause the turntable 105 to pivot. While it is pivoting, the actuator means impart a constant radial force on the feeler 110 urging it towards the bezel 16 so that the feeler finger 112 of the feeler 110 slides along the bottom edge 17 of the bezel 16 without rising up either of the front and rear flanks 16A and 16B of the bezel 16.

While the turntable 105 is turning, the electronic and/or computer device 120 reads the three-dimensional coordinates $R_j$, $TETA_j$, $Z_j$ of a plurality of points along the bottom edge 17 of the bezel 16 (e.g. 360 points that are angularly spaced apart at one degree intervals). Each point corresponds to substantially the trace of the bottom edge 17 of the bezel in a cross-section $S_j$.

After the turntable 105 has performed one complete revolution, the actuator means stop rotation thereof. The three-dimensional coordinates $R_j$, $TETA_j$, $Z_j$ of the 360 felt points are then transmitted by the electronic and/or computer device 120 to the control unit 251 for controlling the shaper appliance 200.

Shaping Method

The shaping method is implemented in this example by means of a shaper appliance such as the grinder 200 shown in FIG. 6.

The method consists in machining the edge face 23 of the ophthalmic lens 20 to reduce it to the shape of the left rim 11 of the eyeglass frame 10 in such a manner that once the lens 20 is engaged in its rim 11, its front and rear margins 28 and 29 extend respectively at a substantially constant distance from the front and rear margins 18 and 19 of the left rim 11, all around the outline of the rim.

As explained above, the offset height $D_j$ between the front and rear margins 18 and 19 of the rim 11 vary around the outline of the rim. It is therefore appropriate to shape the ophthalmic lens in such a manner that its front and rear margins 28 and 29 are likewise offset relative to each other by a radial difference $D'_i$ relative to the optical axis A2.

As explained in greater detail below, the radial difference $D'_i$ in each axial section $S'_i$ of the lens is deduced from the offset height $D_j$ of the rim in the corresponding cross-section $S_j$. The variations in this radial difference $D'_i$ along the edge face 23 of the ophthalmic lens form a mathematical function referred to as the offset function.

In order to implement the method of shaping the lens, the grinder 200 is initially started so that its control unit 251 causes the five windows 260-264 to be displayed on the display screen 253.

The ophthalmic lens 20, which at this stage still presents the circular outline shown in FIG. 3, is blocked between the two shafts 202 and 203 of the rocker 201 of the grinder 200 by virtue of the second shaft 203 being movable in translation. In this example, the ophthalmic lens 20 is more precisely blocked in such a manner that its optical axis A2 coincides with the blocking axis A7.

The user then begins via the MMI 252 by inputting information available to the user relating to the eyeglass frame 10, to the ophthalmic lens 20, and to the future wearer of the eyeglass frame 10.

More precisely, in the two fields 311 and 312 of the fifth window 264, the user inputs the pupillary distance Ep and the pupil height Hp of the future wearer. The pupillary distance Ep is defined as the horizontal distance between the pupils of the two eyes of the wearer. The pupil height Hp is defined as the vertical distance between the left pupil of the wearer and the lowest point of the left rim 11 of the eyeglass frame 10, as measured when the wearer is wearing the eyeglass frame 10 and is in a straight posture.

In the other two fields 313, 314 of the fifth window 264, the user also inputs the material M of the lens (0 for glass, 1 for polycarbonate), and the height T between the front margin 18 of the left rim 11 and the bottom edge 17 of the bezel 16 of the rim. Specifying the material M enables the lens to be machined at an appropriate machining speed. The height T is initially measured by the user on the rim 11 of the eyeglass frame 10 on any cross-section $S_j$. This height T is assumed in the present example to be constant all around the outline of the left rim 11. In a variant, provision could be made for the field 313 already to contain a standard value so that it is not essential for the user to measure the height T.

Thereafter, in the preliminary field 309 of the fourth window 263, the user inputs a natural number N greater than or equal to 3. This natural number N is selected as a function of the shape of the left rim 11. More precisely, this natural number N is selected to be equal to 3 or 4 if the variations in the offset height $D_j$ around the outline of the left rim 11 are small. In contrast, it is selected to be equal to 5 or 6 if the variations in the offset height $D_j$ around the outline of the left rim 11 are large.

Figure 9:
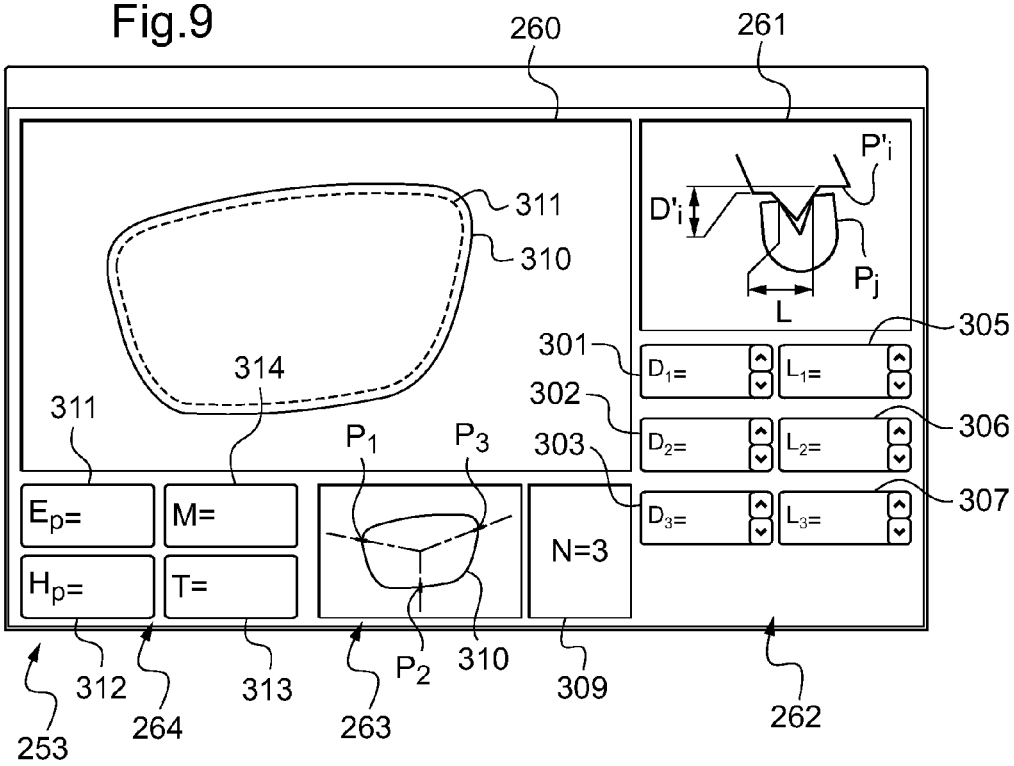

As shown in FIG. 8, the natural number N has been selected to be equal to 4. In FIG. 9, it has been selected to be equal to 3.

As shown in FIGS. 8 and 9, once this natural number N has been selected, the control unit 251 causes a number of points $P_1$-$P_4$ equal to the selected natural number N to be displayed on the outline 310. These points illustrate the positions of cross-sections $S_j$ of the rim 11 where the user needs to measure the offset height $D_j$ manually.

These points $P_1$-$P_4$ are preferably distributed regularly around the outline 310 and they are positioned in such a manner that at least one of them is situated in the zone of the outline that corresponds to the nose zone of the rim.

As shown in FIG. 8, when the natural number N is selected to be equal to 4, four points $P_1$-$P_4$ are displayed situated at the four cardinal points of the outline 310.

The control unit 251 also causes a number of offset fields 301-304 to be displayed in the third window 262, said number being equal to the selected natural number N. It also causes the same natural number N of width fields 305-308 to be displayed.

As shown in FIG. 8, the offset fields 301-304 are used for inputting the values of four offset heights $D_{j=0}$, $D_{j=90}$, $D_{j=180}$, $D_{j=270}$ as measured at four cross-sections $S_{j=0}$, $S_{j=90}$, $S_{j=180}$, $S_{j=270}$ of the left rim 11.

The width fields 305-308 serve to input values for four widths of the opening of the bezel 16, $L_{j=0}$, $L_{j=90}$, $L_{j=180}$, $L_{j=270}$ as measured at the same four cross-sections $S_{j=0}$, $S_{j=90}$, $S_{j=180}$, $S_{j=270}$ of the left rim 11.

In order to fill in these fields, the user takes hold of the eyeglass frame 10 and then estimates by eye or uses a rule to determine the offset height $D_j$ and the opening width $L_j$ of the bezel 16 at each of the four cross-sections $S_{j=0}$, $S_{j=90}$, $S_{j=180}$, $S_{j=270}$ of the left rim 11 situated at the four cardinal points thereof. Thereafter, these values are input into the fields 301-308 provided for this purpose via the MMI 252.

In a variant, the user may do no more than measure and fill in the offset fields 301-304, in which case the width fields 305-308 are filled in automatically with a predetermined standard value.

The control unit 251 then generates a control setpoint for forming the engagement ridge 26 on the edge face 23 of the ophthalmic lens 20, in such a manner that, in each axial section $S'_i$ of the lens 20, the front and rear ends $P'1_i$ and $P'2_i$ of the lens profile $P'_i$ present respective first and second distances $L1_i$, $L2_i$ from the blocking axis A7 (FIG. 7A) with the difference between them $D'_i$ being a function that is not entirely uniform around the edge face 23 of the lens 20, and that depends on the numerical values input in each of the offset fields 301-304.

To do this, the control unit 251 calculates the three-dimensional coordinates $R'_i$, $TETA'_i$, $Z'_i$ of 360 points on the top edge 27 of the engagement ridge 26, and also calculates the second distances $L2_i$ and the radial differences $D'_i$ at each of the 360 axial sections $S'_i$ under consideration of the lens 20.

The three-dimensional coordinates $R'_i$, $TETA'_i$, $Z'_i$ of the 360 points of the top edge 27 of the engagement ridge 26 are calculated using the following formula:

For i=j and for j going from 1 to 360

$$R'_i = R_j - \text{DELTA}$$

$$TETA'_i = TETA_j$$

$$Z'_i = Z_j + f(TETA_j)$$

The constant DELTA is calculated in conventional manner as a function of the height T (between the front margin 18 of the left rim 11 and the bottom edge 17 of the bezel 16 of the rim), of the width $L_j$ at the opening of the bezel 16, and of the apex angles of the conical working surfaces of the finishing wheel 212 (represented by angle C1 in FIG. 10). This constant DELTA serves to take account of the fact that once the lens 20 is engaged in the left rim 11, the top edge 27 of the engagement ridge 26 does not come into contact with the bottom 17 of the bezel 16, but is offset a little therefrom (see FIGS. 10 to 15).

The function $f(TETA_j)$ may be selected to be zero, or constant, or variable, so as to take account of the difference, if any, between the general cambers of the lens 20 and of the left rim 11 of the frame. The selected function serves in particular to modify the axial position of the engagement ridge 26 on the edge face 23 of the ophthalmic lens 20, e.g. so that the engagement ridge 26 extends along the front optical face 21 of the lens 20, or rather in the middle of its edge face 23.

The control unit 251 then proceeds to calculate the shaping radii for the front margin 28 of the ophthalmic lens, i.e. it calculates the distances $L2_i$ at each of the 360 axial sections $S'_i$ under consideration of the lens 20.

These shaping radii $L2_i$ are deduced using the following formula:

$$L2_i=R'_i-T-K, \text{ where K is a positive constant or zero.}$$

The front margin 28 of the edge face 23 of the ophthalmic lens 20 is thus designed to extend at a radial distance from the top edge 27 of the engagement ridge 26 that is constant and that is equal to a height T+K that is greater than or equal to the height of the engagement ridge 26, e.g. equal to 0.6 millimeters.

In a variant, this radial distance could naturally be selected in some other way. In particular, it could be selected to vary as a function of the numerical values input in each of the offset fields 301-304.

Finally, the control unit 251 calculates the offset function, i.e. it calculates the radial differences $D'_i$ at the 360 axial sections $S'_i$ under consideration of the lens 20.

Since four offset heights $D_{j=0}$, $D_{j=90}$, $D_{j=180}$, $D_{j=270}$ have been input for four cross-section $S_{j=0}$, $S_{j=90}$, $S_{j=180}$, $S_{j=270}$ of the rim 11, the control unit 251 deduces the radial difference $D'_i$ at each of the four corresponding axial sections $S'_{i=0}$, $S'_{i=90}$, $S'_{i=180}$, $S'_{i=270}$ of the lens 20, using the following formula:

For i=j and j=0, 90, 180, and 270

$$D'_i=D_j+\text{DELTA2}$$

The constant DELTA2 is a positive value close to 0. In this embodiment it is selected to be equal to 0.5 millimeters.

In the event of an erroneous measurement, it serves to ensure that the radial difference $D_i$ between the front and rear margins 28 and 29 of the edge face 23 of the lens 20 is sufficient to avoid any problem of interference between the rear margin 29 of the lens 20 and the rear margin 19 of the rim 11 of the frame (see FIG. 12).

When the rim 11 of the frame 10 is skewed (FIG. 11), this constant also serves to ensure that the lens remains suitable for mounting in the rim even if the offset height $D_j$ is not measured in the most highly skewed zones of the rim of the frame.

Finally, when the lens is thick (FIGS. 13 and 14), this constant also serves to ensure that the rear margin 29 of the edge face of the lens 20 does not interfere with the corresponding nose pad 13 of the rim 11 of the eyeglass frame.

When the ophthalmic lens 20 is identified as being a thin lens (FIG. 15), the value of this constant DELTA2 may be reduced, possibly down to zero.

The control unit 251 then determines the radial difference $D'_i$ at each of the 356 other axial sections $S'_i$ of the ophthalmic lens 20 using any appropriate interpolation function. In this embodiment, the interpolation function is a continuous Lagrange function having a derivative that is continuous and presenting an absolute value that remains less than a predetermined threshold value.

In a variant, the control unit 251 could be adapted to generate the control setpoints in such a manner that the offset function varies stepwise between each of the four axial sections $S'_{i=0}$, $S'_{i=90}$, $S'_{i=180}$, $S'_{i=270}$ under consideration.

In another variant, the interpolation function may be a trigonometrical function calculated as follows:

For i going from 0 to 90

$$D'_i=D'_{i=0}+(D'_{i=90}-D'_{i=0}).\sin(\text{TETA}'_i)$$

For i going from 90 to 180

$$D'_i=D'_{1=90}+(D'_{i=180}-D'_{i=90}).\sin(\text{TETA}'_i-90)$$

For i going from 180 to 270

$$D'_i=D_{i=180}+(D'_{i=270}-D'_{i=180}).\sin(\text{TETA}'_i-180)$$

For i going from 270 to 360

$$D'_i=D'_{i=270}+(D'_{i=0}-D'_{i=270}).\sin(\text{TETA}'_i-270)$$

Finally, the control unit 251 deduces from the radial differences $D'_i$, the shaping radii $L1_i$ for the rear margin 29 of the ophthalmic lens 20 using the following formula:

For i going from 0 to 359

$$L1_i=L2_i+D'_i$$

Thereafter, the control unit 251 causes the second window 261 to display simultaneously:

- the rim profile $P_{j=0}$ that is defined by the first cross-section $S_{j=0}$ of the left rim 11 and that presents an offset height $D_{j=0}$ and an opening width $L_{j=0}$; and
- the lens profile $P'_{i=0}$ that is defined by the corresponding axial section $S_{i=0}$ of the lens 20 and that is of a shape that is deduced from the previously calculated values $L_{i=0}$, $L2_{i=0}$, and $R'_{i=1}$.

The two profiles $P_{j=0}$ and $P'_{i=0}$ are close to each other, so as to illustrate the way in which the engagement ridge 26 engages in the bezel 16 of the left rim 11.

The control unit 251 also causes the first window 260 to display in superposition:

- the first outline 310 that is representative of the outline described by the top edge 27 of the engagement ridge 26 along the edge face of the ophthalmic lens 20, of coordinates that are deduced from the coordinates $R'_i$, $\text{TETA}'_i$ of the top edge 27; and
- the second outline 311 that is representative of the outline described by the rear end $P'1_i$ of the lens profile $P'_i$ along the edge face of the ophthalmic lens 20, and of coordinates that are deduced from the coordinates $L1_i$, $\text{TETA}'_i$ of the rear margin 27 of the ophthalmic lens.

Only this second outline 311 presents a shape that is deduced from the offset function.

Figure 15:
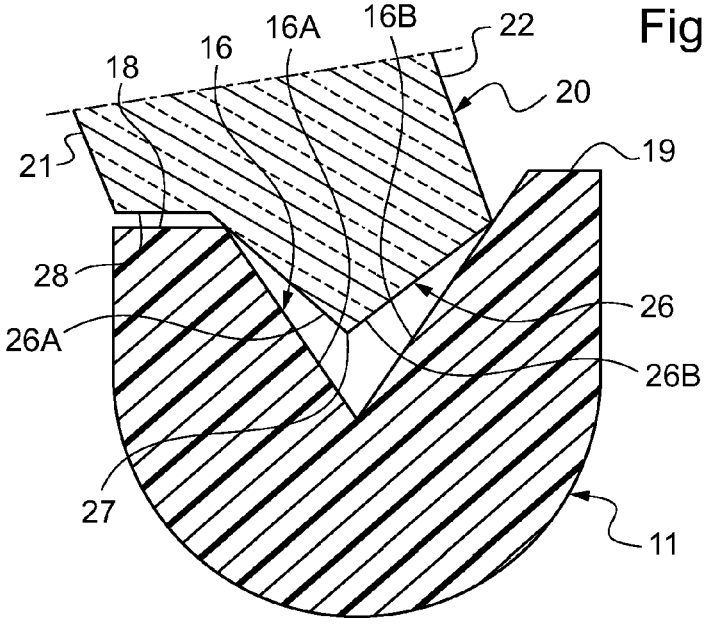

Provision may be made for this second outline 311 to be displayed in two different colors, a first color for zones where the edge face 23 of the lens 20 presents sufficient thickness to have front and rear margins 28 and 29 (FIGS. 10 to 14), and a second color for the zones where the edge face 23 of the lens does not present sufficient thickness to present a rear margin 29 (FIG. 15).

The optician can thus modify the values input in the offset fields 301-304 so as to ensure that the rear margin 29 extends over the entire edge face 23 of the lens 20. This margin ensures that the lens is mounted with pleasing appearance in the left rim 11, as would not be the case if the lens were to be provided with such a margin over a portion only of its edge face.

Thereafter, the user confirms the values that have been input so that the control unit 251 can proceed with shaping the ophthalmic lens 20.

During this confirmation step, provision may be made to store all of the data that has been input in a new record in a database registry accessible to the grinder. Such a registry has a plurality of records, each associated with a previously-felt eyeglass frame. Each record then comprises an identifier for the frame, together with the corresponding values that were input previously via the display screen. Thus, when a new client (or eyeglass wearer) selects an eyeglass frame that is identical to an eyeglass frame that has already been selected by an earlier client, the user can search in the registry for the values corresponding to said eyeglass frame, thus avoiding any need to input them again via the display screen.

Shaping is then performed in two stages: roughing out; and finishing.

For roughing out the lens, the cylindrical grindwheel 210 is used so as to reduce the radii of the lens roughly to match the shape calculated for the top edge 27. The cylindrical grindwheel 210 and the rocker 201 are then controlled more accurately relative to each other so as to ensure that in each angular position $TETA'_i$ of the lens about the blocking axis A7, the radius of the lens is reduced to a length that is equal to the radius $R'_i$.

Thereafter, in order to finish the lens, the finishing wheel 212 is used. The control unit 251 then controls the axial position (along the blocking axis A7) of the finishing wheel 212 so as to put a first of its conical working faces 214, 215 in register with one of the front and rear edges of the edge face 23 of the ophthalmic lens 20. Thereafter it controls the radial position of the finishing wheel 212 (relative to the blocking axis A7) so as to machine one of the front and rear flanks 26A and 26B of the engagement ridge 26 and also the front or rear margin 28, 29 adjacent to said flank. The operation is repeated in order to machine the other flanks of the engagement ridge 26 and the margin adjacent thereto.

The machining is performed in such a manner that, at each axial section $S'_i$ of the lens, the front margin 28 of the edge face 23 of the lens is situated at a radial distance $L2_1$ from the blocking axis A7 and the rear margin 29 of the edge face 23 of the lens is situated at a radial distance $L1_i$ from the blocking axis A7.

Once the lens has been shaped, it is extracted from the grinder 200 by making use of the ability of the second shaft 203 to move in translation, and it is then engaged in the left rim 11 of the eyeglass frame 10.

In the event of it not being possible to mount the lens correctly, the user identifies visually the zone(s) of the edge face 23 of the lens 20 that interfere with the rim 11 of the frame, and then modifies the value(s) input in the offset fields 301-304 so as to machine the rear margin 29 of the lens 20 to a greater depth.

The user then blocks the ophthalmic lens 20 once more between the shafts 202 and 203 of the grinder 200 and then relaunches machining by the finishing wheel in order to eliminate these zones of interference.

The invention claimed is:

1. A shaper device (200) for shaping an ophthalmic lens (20), the device comprising:

a blocking support (202, 203) for blocking the ophthalmic lens on a blocking axis (A7);

a shaper tool (210, 212) for shaping the ophthalmic lens, the tool being movable relative to said blocking support (202, 203);

an electronic or computer unit (251) for controlling the position of said shaper tool (210, 212) relative to said blocking support (202, 203); and a man/machine interface (252) connected to said electronic or computer unit (251) and including a display screen (253) and input means (254, 255) for inputting numerical values;

wherein said electronic or computer unit (251) is adapted to display on said display screen (253) at least three so-called "offset" fields (301-304) for inputting numerical values via said input means (254, 255), said fields being displayed simultaneously or in succession, and then for generating a control setpoint for said shaper tool (210, 212) relative to said blocking support (202, 203) for shaping the ophthalmic lens (20) so as to form an engagement ridge (26) on its edge face (23), which ridge presents, in each axial section ($S'_i$) of the ophthalmic lens (20), a profile ($P'_i$) having front and rear ends that present respective first and second distances ($L1_i$, $L2_i$) from the blocking axis (A7) with the difference between said distances being a so-called "offset" function that is not entirely uniform around the edge face of the ophthalmic lens (20), and that depends on the numerical values input into each of the offset fields (301-304).

2. The shaper device according to claim 1, wherein said electronic or computer unit (251) is adapted to display on the display screen (253) at least two superposed outlines (310, 311) simultaneously, each outline being a function of said control setpoint, and only a first outline being dependent on said offset function.

3. The shaper device according to claim 2, wherein the first of the two outlines (310) is representative of the outline described by one of the ends of the profile ($P'_i$) of the engagement ridge (26) around the edge face of the ophthalmic lens (20), and the second of the two outlines (311) is representative of the outline described by the top of the profile ($P'_i$) of the engagement ridge (26) around the edge face of the ophthalmic lens (20).

4. The shaper device according to claim 1, wherein said electronic or computer unit (251) is adapted to display on said display screen (253) exactly four offset fields (301-304).

5. The shaper device according to claim 1, wherein said electronic or computer unit (251) is adapted to display on said display screen (253) a preliminary field (309) for inputting a natural number greater than or equal to 3, and then for displaying on said display screen (253) a number of offset fields (301-304) that is equal to said natural number.

6. The shaper device according to claim 1, wherein said electronic or computer unit (251) is adapted to generate the control setpoint in such a manner that the offset function varies continuously.

7. The shaper device according to claim 6, wherein said electronic or computer unit (251) is adapted to generate the control setpoint in such a manner that, relative to the angular position of the axial section ($S'_i$) in question, the offset function presents a derivative that is continuous.

8. The shaper device according to claim 7, wherein said electronic or computer unit (251) is adapted to generate a control setpoint in such a manner that the absolute value of said derivative is less than a predetermined threshold value at each axial section ($S'_i$) of the ophthalmic lens (20).

9. The shaper device according to claim 1, wherein said electronic or computer unit (251) is adapted to generate a control setpoint in such a manner that the offset function varies stepwise.

10. The shaper device according to claim 1, wherein said electronic or computer unit (251) is adapted to display on the display screen (253) a transverse profile ($P_j$) of the rim of the eyeglass frame (10) simultaneously with the profile ($P'_i$) of said engagement ridge (26).

* * * * *